United States Patent [19]

Lonon

[11] Patent Number: 4,835,795

[45] Date of Patent: Jun. 6, 1989

[54] BODY SUIT AND UNDERPANTS WITH SELF-GRIPPING FASTENERS

[76] Inventor: Edward M. Lonon, 155 Sanford St., East Orange, N.J. 07018

[21] Appl. No.: 177,177

[22] Filed: Apr. 4, 1988

[51] Int. Cl.[4] ..... A41B 9/00

[52] U.S. Cl. ..... 2/408; 450/112

[58] Field of Search ..... 2/400, 402, 408; 450/102

[56] References Cited

U.S. PATENT DOCUMENTS

| | | | |
|---|---|---|---|
| 1,297,481 | 3/1919 | Lebovitz | 2/408 X |
| 1,439,649 | 12/1922 | Stein | 2/408 |
| 1,469,287 | 10/1923 | Torchia | 2/408 |
| 2,397,641 | 4/1946 | Blair | 2/408 X |
| 2,638,900 | 5/1953 | Gruenberg et al. | 2/400 X |
| 3,279,469 | 10/1966 | Schustack | 2/408 X |
| 3,974,836 | 8/1976 | Carlson | 2/408 X |
| 4,280,230 | 7/1981 | LaFleur | 2/408 |
| 4,446,575 | 5/1984 | Davis | 2/408 X |
| 4,597,110 | 7/1986 | Smith, Sr. et al. | 2/408 |
| 4,637,078 | 1/1987 | Southwell | 2/408 |

FOREIGN PATENT DOCUMENTS

| | | | |
|---|---|---|---|
| 139568 | 11/1934 | Austria | 2/224 |
| 208956 | 10/1907 | Fed. Rep. of Germany | 2/408 |
| 562013 | 6/1973 | Switzerland | 2/353 |
| 465279 | 5/1937 | United Kingdom | 2/408 |

OTHER PUBLICATIONS

Gershman, Maurice, *The Journal of the AMA,* "Self Adhering Nylon Tapes," vol. 168, No. 7, p. 930, dated Oct. 19, 1958.

*Primary Examiner*—Werner H. Schroeder
*Assistant Examiner*—Jeanette E. Chapman
*Attorney, Agent, or Firm*—Martha G. Pugh

[57] ABSTRACT

Body suits and underpants in which a seat flap at the crotch is readily opened or closed by means of a self-gripping fastener. A particular feature is that the seat flap may be fastened to the rear panel when open. One embodiment, which includes self-gripping fasteners on the side, as well as on the seat flap, enables the garment to be opened out flat for laundry and storage convenience.

3 Claims, 4 Drawing Sheets

BODY SUIT AND UNDERPANTS WITH SELF-GRIPPING FASTENERS

BACKGROUND OF THE INVENTION

This relates in general to designs for underwear, more particularly men's, women's and children's underpants and body suits, and unique devices for fastening and unfastening the same.

In the case of most types of underwear, for bathroom use, particularly by women, it may be necessary to at least partially remove the garment. This is inconvenient and time consuming. Accordingly, it is the principal object of this invention to provide an improved garment for body wear, particularly an undergarment, in which the seat flap is readily opened and refastened without removing the garment.

Another object of the invention is to provide a garment in which the seat flap can be readily fastened in open position to avoid soiling the garment.

BRIEF DESCRIPTION OF THE INVENTION

These and other objects are realized in garments, such as underpants, or body suits, fashioned in accordance with the present invention, having front and back body panels which terminate in a narrow connecting seat flap several inches wide, constructed to cover the crotch. In a preferred embodiment, one end of the narrow seat flap is integral with or connected to the center of the back body panel. Across the other end of the seat flap on the underside, is sewn, or otherwise secured, a first strip comprising the hook type of a self-gripping fastening material, such as, for example, that sold under the registered tradename VELCRO (brand) by Velcro U.S.A. Inc. of Manchester, N.H. A second mating strip of loop type of VELCRO (brand) material or the like is sewn or secured to the front central lower body portion, just above the crotch area, so that the seat flap of the garment may be closed to form pants when the first and second VELCRO (brand) strips are mated together, the pants being opened when the first and second VELCRO (brand) strips are pulled apart.

A third similar VELCRO (brand) strip comprising loop type VELCRO (brand) fastening material is sewn or otherwise secured transversely to the upper back body portion of the garment, so that when the seat flap is unfastened, its end may be folded back and secured to the third VELCRO (brand) strip, so that the seat flap is out of the way, and not in a position to be soiled.

It will be apparent that an undergarment of the type described, comprising front and back body panels connected by a seat flap, is adapted to be used in many different designs of underpants and body suits, all of which include front and back body panels and a seat flap which is opened and closed with facility.

In addition to the above, men's and women's underpants and panties may also include side openings which are closed by matching VELCRO (brand) strips. Thus, the garment may be opened up to provide a single flat piece to facilitate washing and ironing, with no buttons or snaps to become lost in the laundry process.

These and other objects, features and advantages may be better understood from a study of the specification hereinafter with the attached drawings.

SHORT DESCRIPTION OF THE DRAWINGS

DETAILED DESCRIPTION OF THE DRAWINGS

Figure 2:
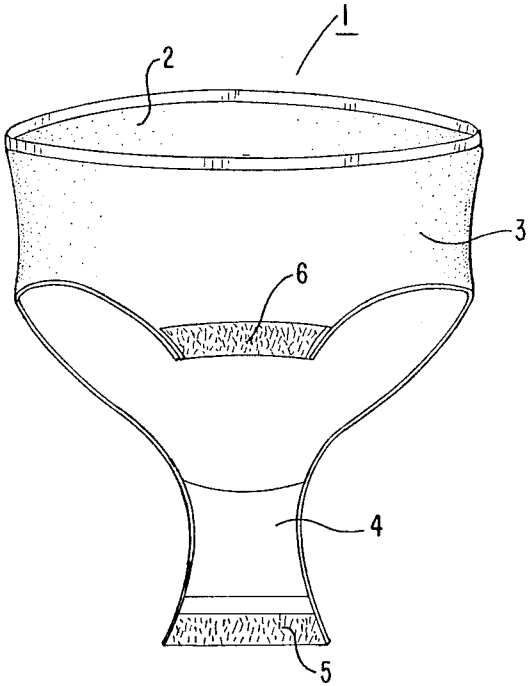
FIG. 2 shows a front view of underpants in accordance with FIG. 1 of the present invention with the seat flap open.
Figure 1:
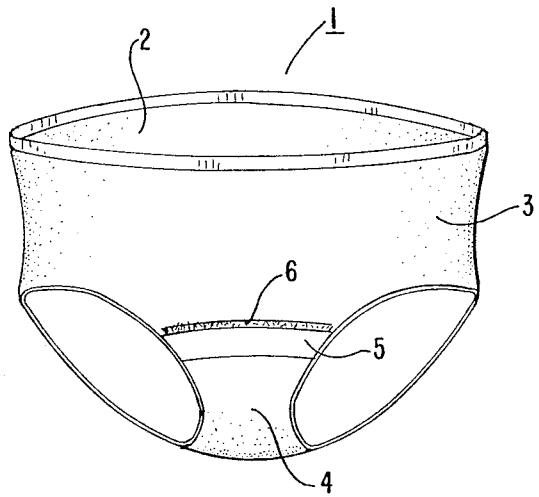
FIG. 1 shows a front view of underpants in accordance with the present invention with the seat flap closed with a VELCRO (brand) fastener.
Figure 4:
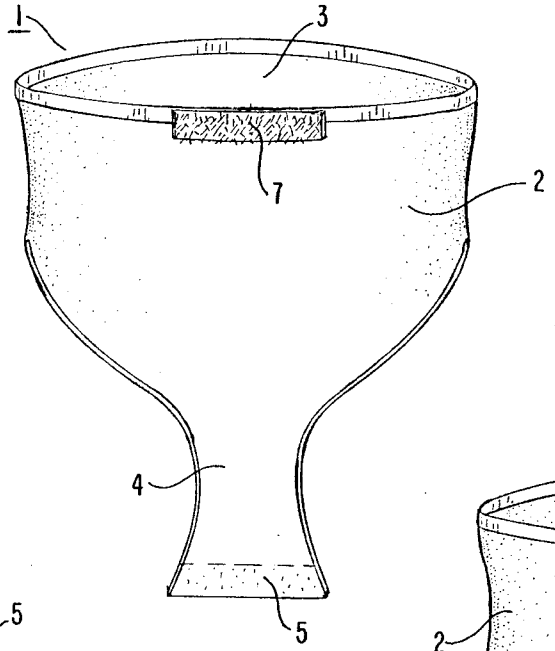
FIG. 4 shows a rear view of underpants in accordance with FIG. 1 of the present invention with the seat flap open.
Figure 5:
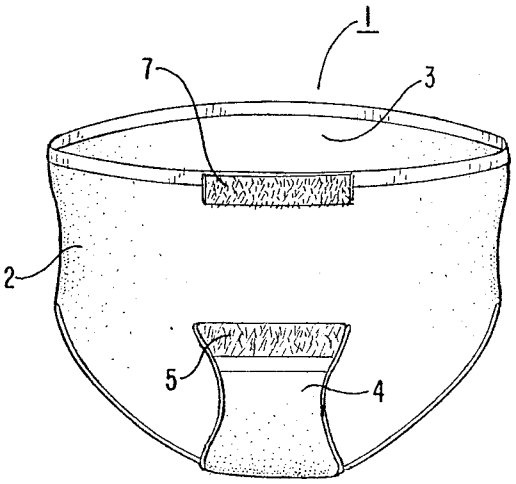
FIG. 5 shows a rear view of underpants in accordance with FIG. 1 of the present invention with the seat flap open and being fastened in the rear.

The present invention relates to undergarments or body suits, for men, women and children, made of any fabrics usual for such applications, such as, for example, knit wear.

FIGS. 1–5 show underpants, which may be sized to fit men, women or children, but in the present illustrative example, may be assumed to be a pair of women's underpants. These may, for example, be made of stretch nylon, the body portion of which is formed in accordance with any well-known patterns and shapes, having a back body panel 2 and a front body portion 3, which may be formed integrally either from a single tubular piece, dimensioned and designed to surround the lower body portion of the wearer, or alternatively, may be formed of a larger back panel and a slightly smaller front panel seamed together at the sides, and open at the top, which is usually formed with some type of elastic waist band. The left and right sides of the front and back body panels are conventionally formed with semicircular cut outs to accommodate the thighs of the wearer.

In the garment 1 under description, the width of the waist band is, say, 13½ inches. The opposite sides of the front and back body panels, which may be integrally formed, or seamed, extend, say, 4 inches from the waist band to the thigh.

Attached to the lower portion of the back is a flap 4, say, about 4½ inches wide at the ends, 3 inches wide in the center, and 6 inches long, which terminates inside of its front end in a strip 5 of hook type VELCRO (brand) material about 4½ inches long and ¾ inch wide, which is constructed to mate with a similarly dimensioned strip 6 of loop type VELCRO (brand) material which is sewn or otherwise secured to the center of the front body panel 3. VELCRO, as used in the specification and claims hereinafter is the registered trademark of VEL- CRO U.S.A., Inc., and is the brand name for a self-gripping fastener, defined as a material sold in pieces or strips comprising a complementary hook and loop parts which strongly adhere to one another when pressed together, and which, with some effort, may be pulled apart. VELCRO (brand) material of a type suitable for the purposes of the present invention is described in detail in U.S. Pat. No. 2,717,437, issued Sept. 13, 1955, which is incorporated herein by reference.

Figure 3:
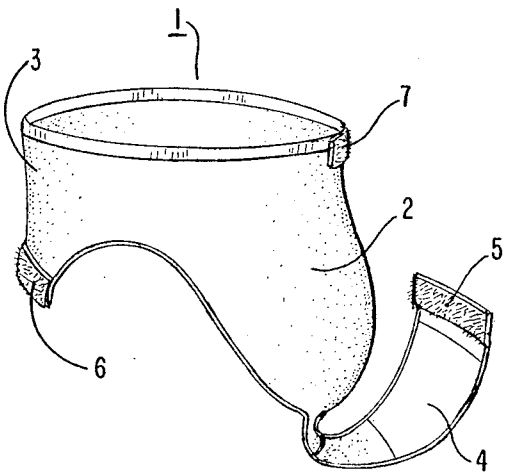
FIG. 3 shows a side view of underpants in accordance with FIG. 1 of the present invention with the seat flap open.

When the VELCRO (brand) strips 5 and 6 are fastened together, they form conventional pant leg openings. When the VELCRO (brand) self-gripping fastening strips 5 and 6 are pulled apart, the flap 4 may be pulled back as shown in FIG. 3 and attached in the back panel to a mating strip of loop type VELCRO (brand) material 7 of comparable length and width to the strip 5. The strip 7 is sewn or otherwise secured to the central portion of the waist band, say, 10 inches above the crotch, at the upper end of the back body panel 2, thus, enabling the flap 4 to be fastened out of the way.

Figure 6:
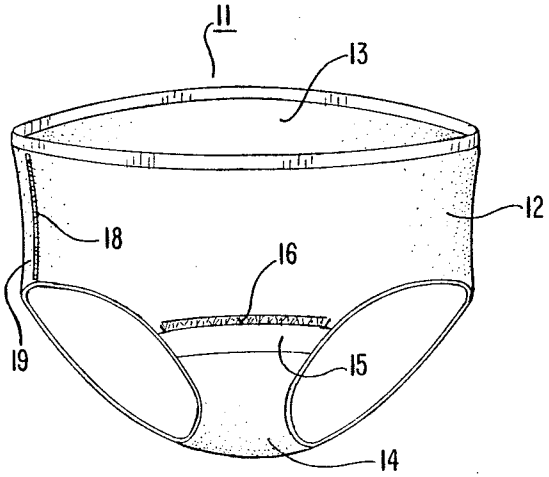
FIG. 6 shows a front view of a modified design of underpants, in accordance with the present invention having the front flap and the side opening of the garment both closed with VELCRO (brand) fasteners.

It will also be understood that in addition to the opening which is closed by the mating VELCRO (brand) strips 5 and 6 at the crotch, the garment may optionally have one or more side openings as shown in FIG. 6.

Figure 7:
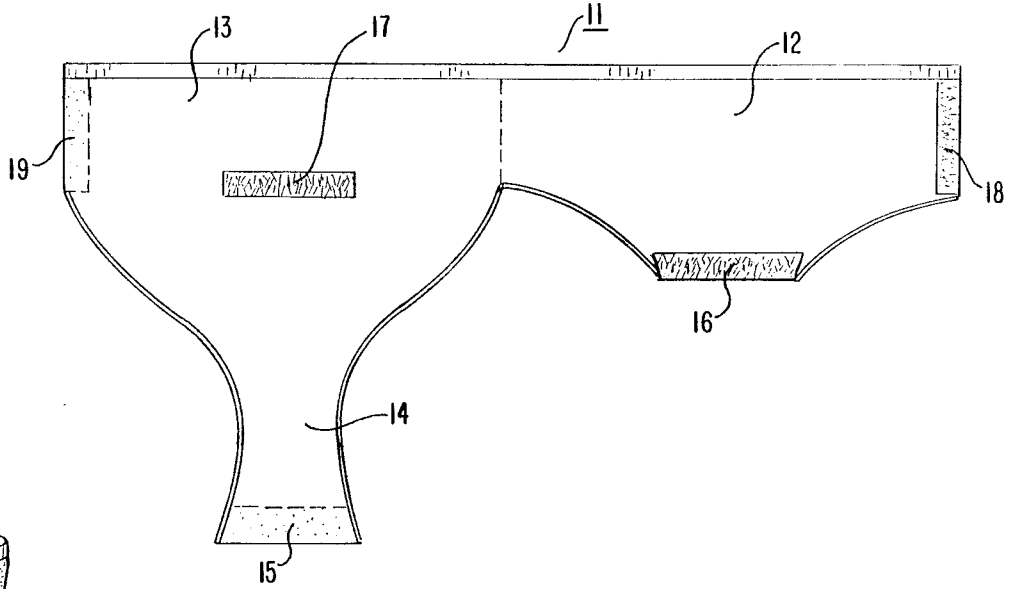
FIG. 7 shows underpants of the modified design of FIG. 5 completely open and flat for convenience in laundering.

A modified form of the garment 11 as shown in FIGS. 6 and 7, may be formed with a lateral opening, closed by the mating hook and loop VELCRO (brand) strips 18 and 19, each, say, 4 inches long and ¾ inch wide, which are respectively sewn, or otherwise secured, to matching sides of the front body panel 12 and the back body panel 13. This feature is a convenience in laundering, ironing and storing the garment. The design of FIG. 6, when spread out flat as shown in FIG. 7, is 26 inches across the waist band portion and 4½ inches along opposite lateral VELCRO (brand) strips 18 and 19 on opposite ends. The back panel 12 extends 13½ inches from the waist band to the seam at the crotch, from which the seat flap 15 extends 7½ inches, being 4 inches wide at the connecting seam, narrowing down to 3 inches in the center and being 4¼ inches across at the open end, along which is sewn, or otherwise secured, the hook type VELCRO (brand) strip 14, which is 4¼ inches long and ¾ inch wide. The front panel 13 is 13 inches across the waist band, 14½ inches across the center, and is 9 inches from the waist to the crotch portion, across which is attached a strip 4 inches long and ¾ inch wide of loop type VELCRO (brand) material.

Figure 9:
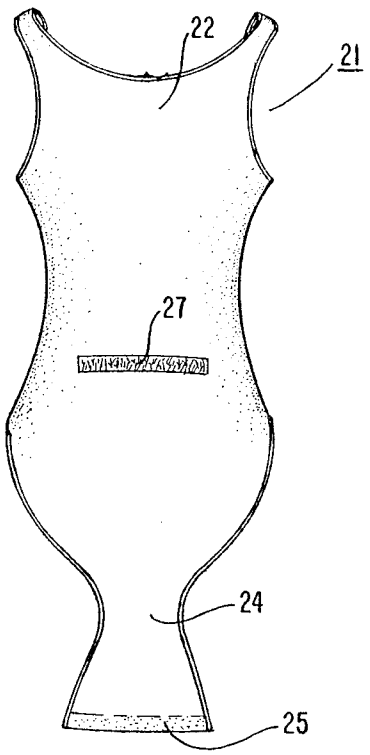
FIG. 9 shows a rear view of a body suit in accordance with FIG. 8 of the present invention, with the seat flap open.
Figure 8:
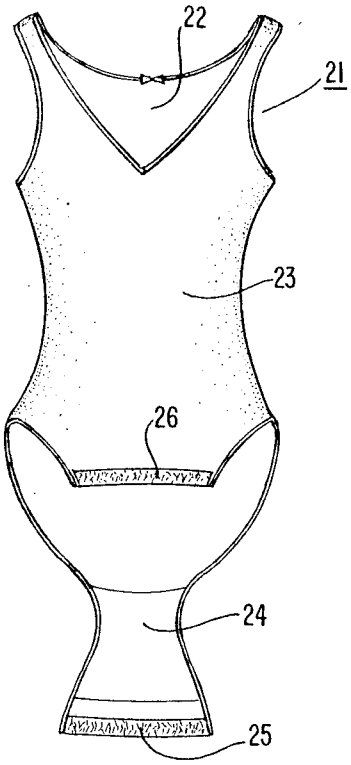
FIG. 8 shows a front view of a body suit, having a VELCRO (brand) seat fastening in accordance with the present invention, with the seat flap open.

Another modification of the garment of the present invention is shown in body suit 21 illustrated in FIGS. 8 and 9 of the drawings. This garment includes a conventional back body panel 22 and front body panel 23 of substantially the forms illustrated, having VELCRO (brand) hook and loop type closures 25 and 26 at the crotch for the front closure, and a separate mating loop type VELCRO (brand) strip 27 attached to the back body panel 22 for fastening the flap 24 out of the way when the crotch portion is opened.

In the illustrative sample under description, each of the sides of the body portion is 10 inches along the seams, from the arm pits to the thigh. The arm loops extend, say, 8 inches above a plane through the arm pits, which is, say, 14 inches across the width. From the center of the neck to the crotch, the front panel 23 measures, say, 12 inches, and terminates in an area centered between the thighs in a laterally-extending strip of loop type VELCRO (brand) material 6½ inches long and ¾ inch wide. The back panel 22 measures, say, 22 inches from the plane between the arm pits to a seam at the center of its lower end, to which is joined the end of the seat flap 24. The latter is 3 inches wide at the junction, narrowing to 2½ inches at its center, and broadening to 6 inches across its end, to which is sewn, or otherwise secured, a strip 25 of hook type VELCRO (brand) material. An additional strip of loop type VELCRO (brand) material, say, 6½ inches long, is sewn or otherwise secured, to the center of the back panel, say, 12 inches above the junction with the seat flap.

It will be understood that loop type and hook type strips are interchangeable, as long as a gripping relation is obtained between mating pairs.

It will be understood that many variations from what is shown herein by way of illustration, and included in the present invention, only being restricted by recitations of the claims hereinafter.

What I claim is:

1. An undergarment comprising in combination front and back body panels, and a seat flap substantially narrower than said front and back body panels and constructed to be connected between the centers of said front and back body panels to provide leg openings, wherein at least one end of said flap is opened and closed to the front body panel of said garment by pressing together a first and a second mating strip of a self-gripping fastener of a type known by the trademark VELCRO (brand), said first strip being secured transversely to the underside of the end of said seat flap and said second strip being secured transversely to the lower center of said front body panel and wherein a third strip of a self-gripping fastener constructed to mate with said first strip of said self-gripping fastener, is sewn, or otherwise secured, transversely across the upper center of said back body panel, thereby enabling the end of said flap in open position to be folded backwards and fastened to said third strip.

2. A garment in accordance with claim 1 having a side opening between said front and back body panels, and a fourth and a fifth mating strip of said self-gripping fastener material being respectively fastened to the lateral ends of said front and back body panels for opening and closing said front and back body panels, wherein when said self-gripping fastener strips are all disengaged, said garment is constructed to be stretched out in a single plane for convenience in washing, ironing, and storing said garment.

3. A garment in accordance with claim 1 wherein said front and back body panels are constructed to cover the torso of the wearer, extending from the neck to the crotch, and having arm openings on each of its upper sides.

* * * * *